US011528963B1

(12) United States Patent
Separzadeh

(10) Patent No.: US 11,528,963 B1
(45) Date of Patent: Dec. 20, 2022

(54) SYSTEMS, DEVICES, AND METHODS FOR SECURING A DECORATIVE COMPONENT TO FOOTWEAR

(71) Applicant: Joybees LLC, Sherman Oaks, CA (US)

(72) Inventor: Joey Separzadeh, Sherman Oaks, CA (US)

(73) Assignee: JOYBEES LLC, Sherman Oaks, CA (US)

( * ) Notice: Subject to any disclaimer, the term of this patent is extended or adjusted under 35 U.S.C. 154(b) by 0 days.

(21) Appl. No.: 17/855,792

(22) Filed: Jun. 30, 2022

(51) Int. Cl.

| | |
|---|---|
| ***A43B 23/24*** | (2006.01) |
| ***A43B 1/14*** | (2006.01) |
| ***A43D 100/08*** | (2006.01) |
| ***A43B 3/34*** | (2022.01) |
| ***A43B 3/00*** | (2022.01) |

(52) U.S. Cl.
CPC ..... *A43D 100/08* (2013.01); *A43B 3/0078* (2013.01); *A43B 3/34* (2022.01); *A43B 23/24* (2013.01)

(58) Field of Classification Search
CPC ..... A43B 23/24
See application file for complete search history.

(56) References Cited

U.S. PATENT DOCUMENTS 2,139,145 A * 12/1938 Young ..... A44B 1/28 24/104
5,933,929 A * 8/1999 Kawakami ..... A44B 17/0035 24/324
6,568,044 B1 * 5/2003 Kidd ..... A44B 1/28 24/104
7,698,836 B2 4/2010 Schmelzer et al.
8,069,538 B2 * 12/2011 Wilcox ..... A43C 1/00 24/628
8,122,519 B2 2/2012 Schmelzer et al.
8,782,814 B2 * 7/2014 Schmelzer ..... A43C 11/24 63/23
9,210,959 B1 * 12/2015 Jankowski ..... A41D 27/08
2008/0060110 A1 * 3/2008 Schmelzer ..... A44B 1/32 2/69
2008/0127525 A1 * 6/2008 Blunden ..... A43B 3/0078 63/1.11
2010/0162591 A1 * 7/2010 Schmelzer ..... A44B 1/14 36/136
2015/0282575 A1 * 10/2015 Smith ..... A43B 1/14 63/3

* cited by examiner

*Primary Examiner* — Jila M Mohandesi
(74) *Attorney, Agent, or Firm* — Concept IP LLP; Pejman Yedidsion

(57) ABSTRACT

Systems, devices, and methods including a tapered shaft having a first end and a second end, wherein the first end is distal from the second end, where a diameter of the first end is smaller than a diameter of the second end; a fixed footwear holder secured to the first end of the tapered shaft; a fixed charm mount secured to the second end of the tapered shaft; a floating washer disposed about the tapered shaft, where an aperture of the floating washer has an inner diameter that is greater than the diameter of the first end and less than the diameter of the second end; and where the fixed charm mount is configured to securely fasten a charm; and where a length of the tapered shaft is greater than a maximum distance between the floating washer and the fixed footwear holder.

13 Claims, 7 Drawing Sheets

SYSTEMS, DEVICES, AND METHODS FOR SECURING A DECORATIVE COMPONENT TO FOOTWEAR

TECHNICAL FIELD

Embodiments relate generally to footwear, and more particularly to footwear accessories.

BACKGROUND

People may be interested in customizing their clothing, including shirts, jackets, pants, and footwear. Decorative pins, clips, patches, and other accessories may be added to clothing based on a desired appearance by the wearer. Adding decorations to off-the-shelf products can provide a custom appearance for the wearer that may allow the wearer to promote their favorite hobbies, music, or interests.

SUMMARY

A device embodiment may include: a tapered shaft having a first end and a second end, where the first end may be distal from the second end, where a diameter of the first end may be smaller than a diameter of the second end; a fixed footwear holder secured to the first end of the tapered shaft; a fixed charm mount secured to the second end of the tapered shaft; a floating washer disposed about the tapered shaft, where an aperture of the floating washer has an inner diameter that may be greater than the diameter of the first end and less than the diameter of the second end; and where the fixed charm mount may be configured to securely fasten a charm; and where a length of the tapered shaft may be greater than a maximum distance between the floating washer and the fixed footwear holder.

In additional device embodiments, a portion of the tapered shaft may be configured to be inserted into an aperture in a footwear. In additional device embodiments, the fixed footwear holder may be configured to secure the device against an inner surface of the footwear. In additional device embodiments, the floating washer may be configured to secure the device against an outer surface of the footwear. In additional device embodiments, the charm may be configured to be positioned in an elevated position above the outer surface of the footwear. In additional device embodiments, the fixed charm mount may be configured to be positioned in an elevated position above the outer surface of the footwear.

In additional device embodiments, a top surface of the fixed footwear holder comprises a texture to allow for greater grip with an inner surface of the footwear. In additional device embodiments, a bottom surface of the floating washer comprises a texture to allow for greater grip with an outer surface of the footwear.

In additional device embodiments, the tapered shaft may be a single piece. In additional device embodiments, the tapered shaft, the fixed footwear holder, the fixed charm mount, and the floating washer may be formed as a single piece. In additional device embodiments, the floating washer may be secured to the tapered shaft by a breakable portion, and where breaking the breakable portion allows the floating washer to move along the maximum distance between the floating washer and the fixed footwear holder.

In additional device embodiments, the charm may be secured to the fixed charm mount by at least one of: a glue, an adhesive, and a cement. In additional device embodiments, the device further comprises one or more of: a battery, a speaker, an RFID, a GPS locator, and a light up element. In additional device embodiments, the device further comprises one or more of: a real gem, a fake gem, a metal, a metallic embellishment detail, and a textile element.

A method embodiment may include: inserting a fixed footwear holder of a device through an aperture in a footwear, where the fixed footwear holder may be secured to a first end of a tapered shaft, and where a portion of the tapered shaft remains in the aperture after the fixed footwear holder may be inserted through the aperture; securing, by the fixed footwear holder, the device against an inner surface of the footwear; securing, by a floating washer disposed about the tapered shaft, the device against an outer surface of the footwear; and positioning a fixed charm mount in an elevated position above the outer surface of the footwear, where the fixed charm mount may be secured to the second end of the tapered shaft.

In additional method embodiments, the elevated position of the fixed charm mount above the outer surface of the footwear may be configured to prevent granular material from being trapped between the footwear and the fixed charm mount. Additional method embodiments may include: rotating a position of a charm securely fastened to the fixed charm mount relative to the footwear, where the charm does not impinge on the top surface of the footwear throughout the rotation of the charm.

Another method embodiment may include: forming a device comprising a tapered shaft having a first end and a second end, a fixed footwear holder secured to the first end of the tapered shaft, a fixed charm mount secured to the second end of the tapered shaft, and a floating washer disposed about the tapered shaft and connected to the tapered shaft by a breakable portion; breaking the breakable portion connecting the floating washer to the tapered shaft such that the floating washer may be movable along a portion of the tapered shaft; and securing a charm to the fixed charm mount.

In additional method embodiments, forming the device comprises injection molding the device. In additional method embodiments, forming the device comprises 3D printing the device.

BRIEF DESCRIPTION OF THE DRAWINGS

The components in the figures are not necessarily to scale, emphasis instead being placed upon illustrating the principals of the invention. Like reference numerals designate corresponding parts throughout the different views. Embodiments are illustrated by way of example and not limitation in the figures of the accompanying drawings, in which.

DETAILED DESCRIPTION

The present system embodiments disclose devices and methods for the securing of a device for displaying an ornament, accessory component, or decorative component, for example, a charm, to a footwear as an embellishment to the footwear. A fixed footwear holder is disclosed and configured to secure the device against an inner surface of the footwear. In one embodiment, a floating washer is disclosed as configured to secure the device against an outer surface of the footwear. The charm may be configured to be attached to a fixed charm mount of the floating washer such that the charm is positioned in an elevated position above an outer surface of the footwear.

Figure 1:
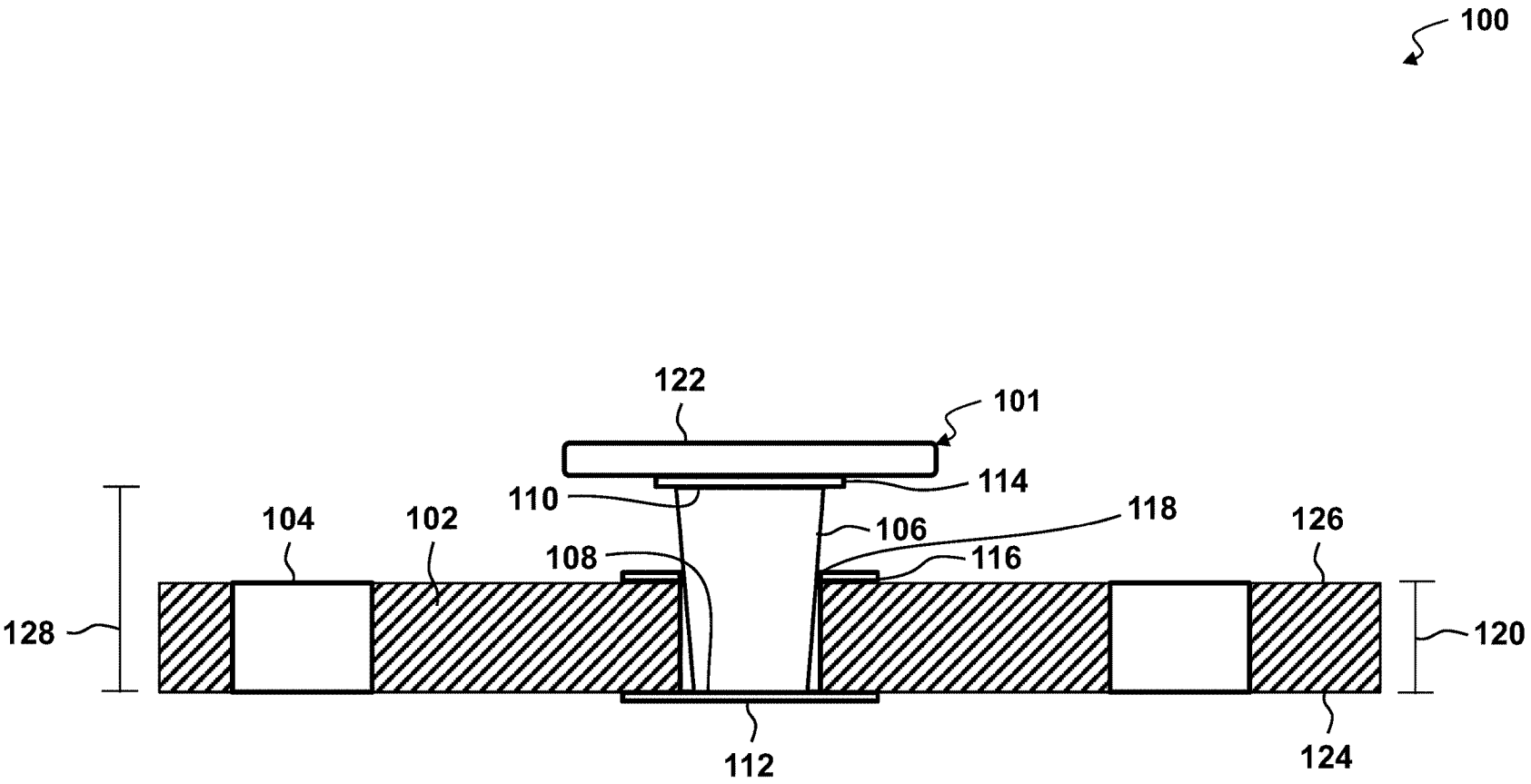
FIG. 1 depicts a side partial cross-sectional view of a device for displaying a charm in a footwear about line A-A of FIG. 3, according to one embodiment.
Figure 3:
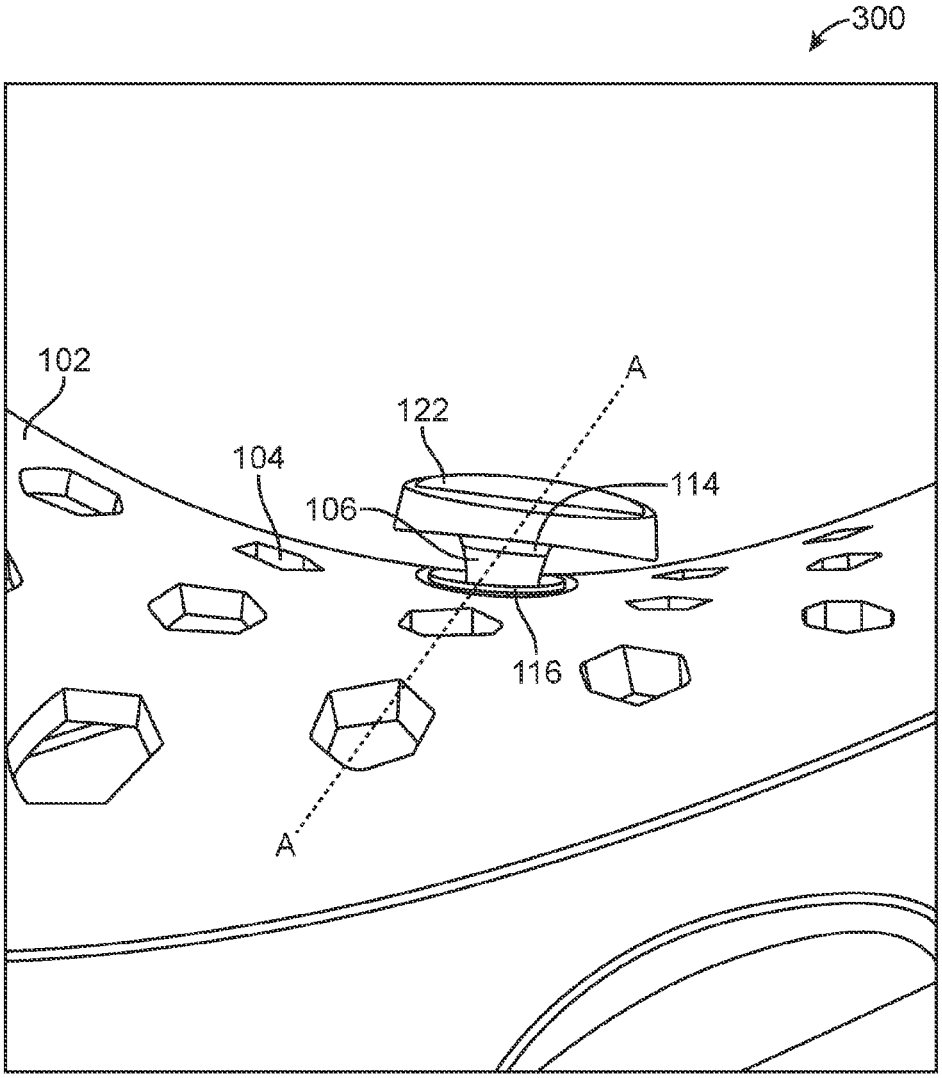
FIG. 3 depicts a perspective view of the device for displaying a charm and footwear of FIG. 1, according to one embodiment.

FIG. 1 depicts a side partial cross-sectional view 100 of a device 101 for displaying a charm 122 in a footwear 102 about line A-A of FIG. 3. The device 101 may include a tapered shaft 106, a fixed footwear holder 112, a fixed charm mount 114, a floating washer 116, and a charm 122.

The tapered shaft 106 may have a first end 108 and a second end 110. The first end 108 of the tapered shaft 106 may be distal from the second end 110 of the tapered shaft 106. A diameter of the tapered shaft 106 may be smaller at the first end 108 of the tapered shaft 106 and larger at the second end 110 of the tapered shaft 106, when comparing the diameter at the first end with the second end. The tapered shaft 106 may have a largest diameter at the second end 110 of the tapered shaft 106. The tapered shaft 106 may have a smallest diameter at the first end 108 of the tapered shaft 106. The tapered shaft 106 may be a single piece shaft, such that in one embodiment, the thickness (measured by the length of the diameter) reduces moving from the second end 110 toward the first end 108. In one embodiment, the shaft may form a conical shaft with varying radius. In one embodiment, the shaft may be a circular uniformly tapered shaft. In one embodiment the shaft may have a hollow cross-section. In some embodiments, the shaft may not be tapered and may have a substantially constant cross-section. In embodiments with a non-tapered shaft, the shaft may include a step that comes into contact with the second end 110 of the shaft to create a separation between the floating washer 116 and the charm 122. In embodiments with a non-tapered shaft, the floating washer 116 may have legs that come into contact with the second end 110 of the shaft to create the separation between the floating washer 116 and the charm 122. The device 101 may be made from plastics. Other materials are possible and contemplated.

A fixed footwear holder 112 may be secured to the first end 108 of the tapered shaft 106. The fixed footwear holder 112 may have a circular shape in some embodiments. The fixed footwear holder 112 may have an oval shape in some embodiments. In other embodiments, the fixed footwear holder 112 may have any other shape, such as a square, hexagon, and the like. The fixed footwear holder 112 may have a thin width relative to a length and/or diameter of the fixed footwear holder 112. The fixed footwear holder 112 is configured in some embodiments to secure the device 101 against an inner surface 124 of the footwear 102. In some embodiments, a bottom surface of the fixed footwear holder 112 may have a padding to allow for more comfort if the fixed footwear holder 112 contacts a foot of a wearer of the footwear. In some embodiments, a top surface of the fixed footwear holder 112 may have a texture to allow for greater grip with an inner surface of the footwear. In some embodiments, the fixed footwear holder 112 may have a circular or any other shape. In other embodiments, the fixed footwear holder may have a rounded hexagon backer.

A fixed charm mount 114 may be secured to the second end 110 of the tapered shaft 106. The fixed charm mount 114 may be a fixed ornament mount, a fixed accessory component mount, and/or a fixed decorative component mount. The fixed charm mount 114 may be distal from the fixed footwear holder 112. The fixed charm mount 114 is positioned in some embodiments above a top surface 126 of the footwear 102 such that the fixed charm mount 114 does not contact the top surface 126 of the footwear 102 when the device 101 is installed or mounted in an aperture 104 of the footwear 102.

In one embodiment of the disclosed systems and devices, a floating washer 116 may be disposed about the tapered shaft 106. The floating washer 116 may be an outer diameter and an inner diameter. The inner diameter may be defined by an aperture 118. The inner diameter of the floating washer 116 is smaller than an outer diameter of the floating washer. The floating washer 116 may have a same or similar outer diameter as the fixed footwear holder 112. The floating washer 116 may have a same or similar width or thickness as the fixed footwear holder 112. An inner diameter or aperture 118 of the floating washer 116 may be smaller than the diameter of the tapered shaft 106 at the second end 110. The aperture 118 of the floating washer 116 may be larger than the diameter of the tapered shaft 106 at the first end 108. Accordingly, the floating washer 116 may be movable only about a portion of the tapered shaft 106 that is a distance 120 between the floating washer 116 and the fixed footwear holder 112. The floating washer 116 may not be movable along an entire length of the tapered shaft 106. The larger diameter of the tapered shaft 106 toward the second end 110 prevents the floating washer 116 from contacting and/or moving proximate to the second end 110 of the tapered shaft 106. That is, in the disclosed embodiments, the floating washer 116 remains distal from the second end 110 of the tapered shaft 106 due to the tapering of the tapered shaft 106 that limits movement of the floating washer 116 along a length of the tapered shaft 106. The floating washer 116 is configured to secure the device 101 against an outer surface 126 of the footwear 102. In some embodiments, a bottom surface of the floating washer 116 may have a texture to allow for greater grip with an outer surface of the footwear.

A charm 122 may be secured to the fixed charm mount 114. The charm may be made out of one or more of: resin, polyvinyl chloride (PVC), thermoplastic polyurethane (TPU), textiles, and metal.

The device 101 may be detachably installed into an aperture 104 in the footwear 102. A portion of the tapered shaft 106 is configured to be inserted into the aperture 104 in the footwear 102. The fixed footwear holder 112 may also be configured to be inserted into the aperture 104 in the footwear 102. The fixed footwear holder 112 is configured to secure the device 101 against an inner surface 124 of the footwear 102. The floating washer 116 may not be inserted into the aperture 104 in the footwear 102. In some embodiments, the floating washer 116 may be sized to prevent insertion of the floating washer through an aperture 104 in the footwear 102. The floating washer 116 is configured to secure the device 101 against an outer surface 126 of the footwear 102.

In one embodiment, a length of the tapered shaft 128 as measured along a length of the tapered shaft 128 between a first end and a second end, may be greater than a distance 120 between the floating washer 116 and the fixed footwear holder 112 such that the charm 122 is configured to be positioned in an elevated position above the outer surface 126 of the footwear 102. In this elevated position, the surfaces of the floating washer 116 and the charm 122 are not touching. In this elevated position when installed in a footwear as in FIGS. 1 and 3, the surfaces of the charm 122 and the upper surface of the footwear are not touching.

The device 101 elevates the charm 122 above the top surface 126 of the footwear 102 so as to prevent granular material, such as dirt, sand, or the like, from being trapped between the footwear 102 and the charm 122. The washer 116 and the tapered shaft 106 cause the charm 122 to protrude from the footwear 102. The elevated position of the charm 122 above the top surface 126 of the footwear 102 also allows for easier cleaning of the footwear 102 and/or the device 101.

The elevated position of the charm 122 in the device 101 allows the charm to be more prominently displayed above the footwear 102. As a person observing the device 101 is likely to be looking down on the device from a standing or sitting height, the gap between the top surface 126 of the footwear and the charm 122 may provide a better separation of the charm 122 from the footwear 102 so as to draw attention to the charm 122 as a custom element chosen by the wearer of the footwear 102.

It may be easier for a user to install the device 101 in a footwear 102 when the charm 122 is not contacting the top surface 126 of the footwear 102. It is easier to adjust a rotational position of the charm 122 relative to the footwear 102 as the charm 122 does not impinge on the top surface 126 of the footwear 102. The top surface 126 of the footwear 102 is shown as flat for the purpose of illustration. However, the top surface 126 of the footwear 102 may have one or more concave and/or one or more convex portions to conform to a shape of a foot of a user. These one or more concave and/or one or more convex portions may inhibit and/or limit the placement and/or rotation of a charm that is in direct contact with the top surface 126 of the footwear 102. By contrast, the elevated position of the charm 122 in the device 101 disclosed herein is elevated above the top surface 126 of the footwear 102 such that the placement and/or rotation of the charm 122 may be accomplished by a user without limit in any of the one or more concave and/or one or more convex portions of the footwear 102.

In one embodiment, the tapered shaft 106 allows the device 101 to be inserted into a range of apertures 104 in the footwear 102. In some embodiments, the footwear 102 may have apertures 104 of varying sizes. The tapered shaft 106 of the device 101 allows the device to be placed in and/or moved between smaller sized holes and larger sized holes while providing substantial support for the charm 122.

The second end 110 of the tapered shaft may have a larger diameter than the first end 108 of the tapered shaft 106. The charm 122 is attached proximate this larger diameter portion of the tapered shaft 106 so as to provide greater resilience and support to the charm 122 as compared to a shaft having a narrower or constant diameter. The charm 122 may be prone to impacts during use and the larger diameter portion of the tapered shaft 106 provides greater support and resistance to damage during use. In some embodiments, the disclosed device may also be added to one or more of: bags, bracelets, straps, and other accessories as an embellishment. In some embodiments, the one or more of: bags, bracelets, straps, and other accessories may contain one or more apertures or other receptacles to receive the device 101.

Figure 2:
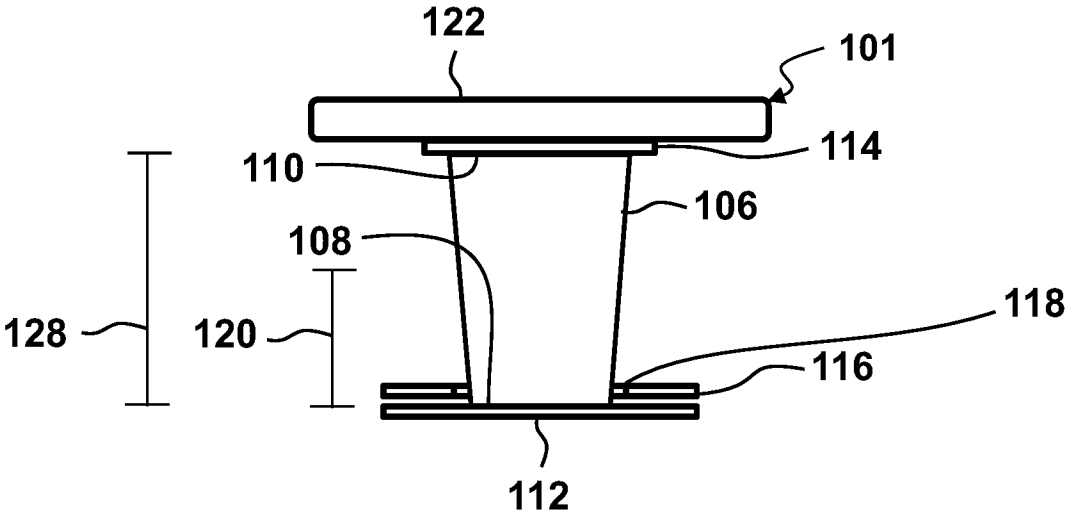
FIG. 2 depicts a side view of the device for displaying a charm of FIG. 1, according to one embodiment.

FIG. 2 depicts a side view of the device 101 for displaying the charm 122 of FIG. 1. The device 101 may include the tapered shaft 106, the fixed footwear holder 112, the fixed charm mount 114, the floating washer 116, and the charm 122. The floating washer 116 is shown as disposed proximate the first end 108 of the tapered shaft 106. The floating washer 116 may move along a portion of the tapered shaft 106 that is measured by a distance 120. The distance 120 may be a maximum travel length for the floating washer 116 along a portion of the length of the tapered shaft 106. The floating washer 116 is limited in movement along the length of the tapered shaft 106 at a point where the inner diameter or aperture 118 of the floating washer is substantially equal to a diameter of the tapered shaft 106. The floating washer 116 is prevented from reaching the second end 110 of the tapered shaft 106, the fixed charm mount 114, and/or the charm 122 by the tapering of the shaft relative to the aperture 118 of the floating washer 116. The funnel shape of the tapered shaft 106 prevents the floating washer 116 from contacting the portion with the charm 122.

FIG. 3 depicts a perspective view 300 of the device for displaying a charm 122 and footwear 102 of FIG. 1. Line A-A denotes a side partial cross-sectional view of the device and footwear 102 as shown in FIG. 1. As shown in the figure, the device (see FIGS. 1 and 2, ref. no. 101) has been installed or mounted on the footwear such that the floating washer 116 is abutting the upper surface of the footwear while the charm 122 secured to the fixed charm mount 114 is separated from the upper surface of the footwear and not making any contact.

Figure 4:
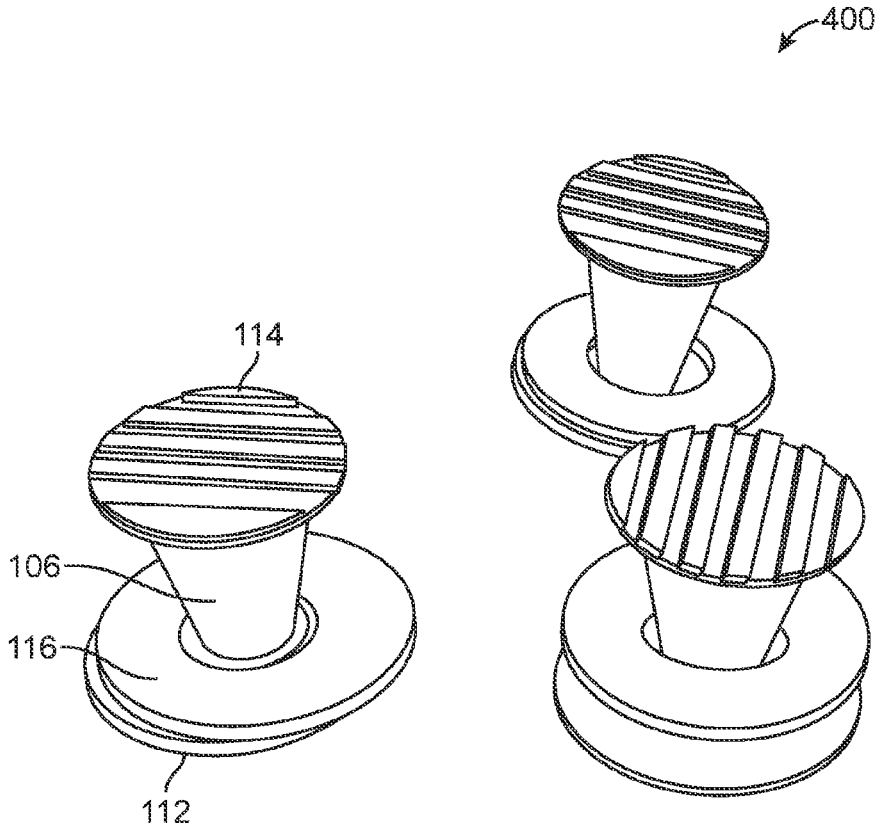
FIG. 4 depicts a perspective view of devices for displaying a charm, according to one embodiment.

FIG. 4 depicts a perspective view 400 of devices for displaying a charm. The charm is not shown. In some embodiments, the top surface of the device may be textured to allow attachment of a charm. In some embodiments, the charm may be attached to the device via glue, adhesives, and/or cement. In some embodiments, the disclosed device may be a unitary part at creation and/or manufacturing, then adjusted for the washer to float. In such embodiments, the device may be initially constructed, assembled, or built as one piece and thereafter the washer, via applying pressure, be separated to allow movement throughout by being disposed about the tapered shaft. In some embodiments, the device may be 3D printed. In other embodiments, the device may be injection molded. The disclosed device may be adjusted in size, ratios, and/or dimensions.

Figure 5:
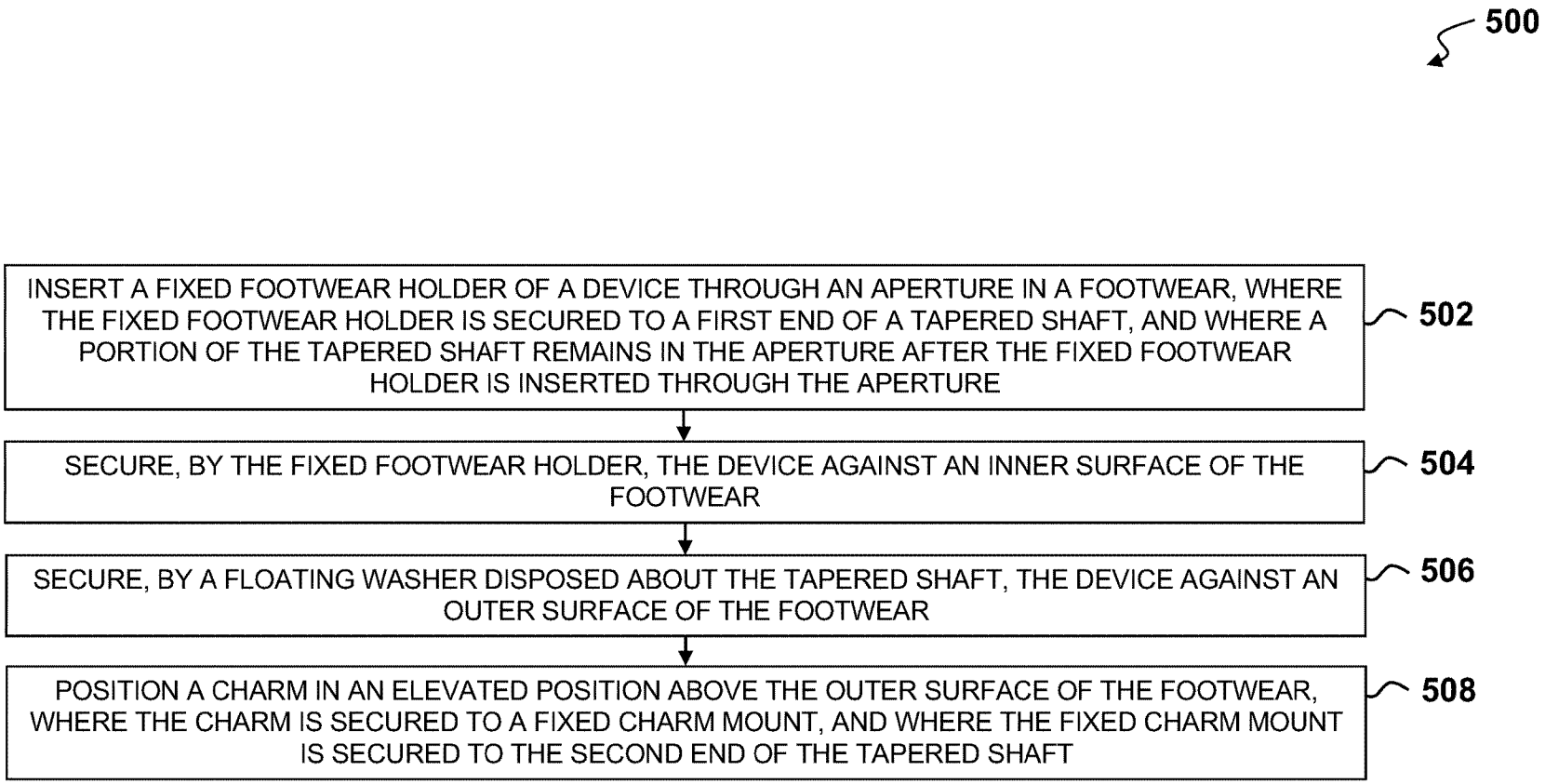
FIG. 5 depicts a high-level flowchart of a method for securing the device for displaying a charm to a footwear, according to one embodiment.

FIG. 5 depicts a high-level flowchart of a method 500 for securing the device for displaying a charm to a footwear. The method 500 may include the steps of (not in any specific order): inserting a fixed footwear holder of a device through an aperture in a footwear, where the fixed footwear holder is secured to a first end of a tapered shaft, and where a portion of the tapered shaft remains in the aperture after the fixed footwear holder is inserted through the aperture (step 502). The method 500 may then include securing, by the fixed footwear holder, the device against an inner surface of the footwear (step 504). The method 500 may then include securing, by a floating washer disposed about the tapered shaft, the device against an outer surface of the footwear (step 506). The method 500 may then include positioning a charm in an elevated position above the outer surface of the footwear, where the charm is secured to a fixed charm mount, and where the fixed charm mount is secured to the second end of the tapered shaft (step 508).

Figure 6:
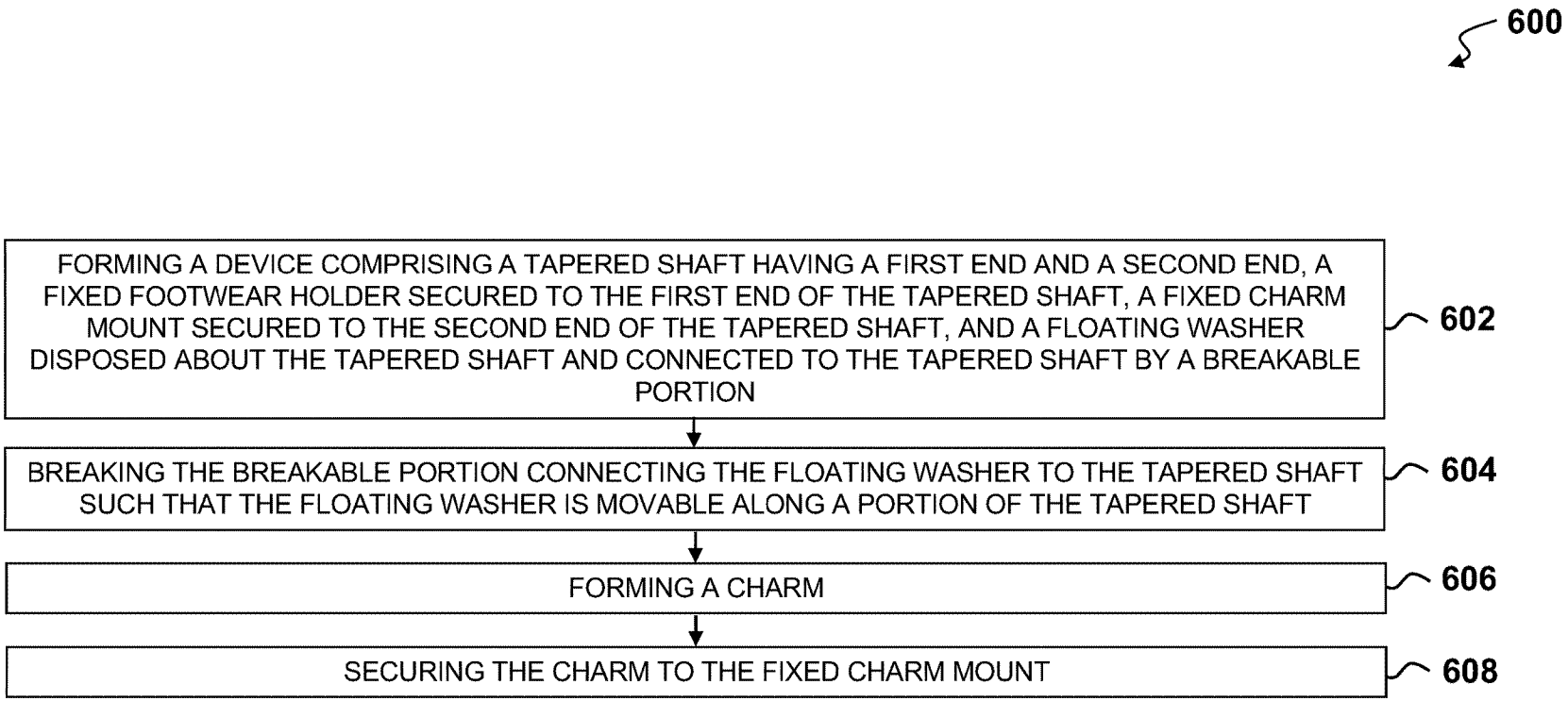
FIG. 6 depicts a high-level flowchart of a method for making the device for displaying a charm to a footwear, according to one embodiment.

FIG. 6 depicts a high-level flowchart of a method 600 for making the device for displaying a charm to a footwear. The method 600 may include the steps of (not in any specific order): forming a device comprising a tapered shaft having a first end and a second end, a fixed footwear holder secured to the first end of the tapered shaft, a fixed charm mount secured to the second end of the tapered shaft, and a floating washer disposed about the tapered shaft and connected to the tapered shaft by a breakable portion (step 602). In some embodiments, the device may be formed by injection molding. In other embodiments, the device may be formed by additive manufacturing or 3D printing. The method 600 may then include breaking the breakable portion connecting the floating washer to the tapered shaft such that the floating washer is movable along a portion of the tapered shaft (step 604). The breakable portion may be a thin portion that allows the floating washer to be formed as a single piece with the rest of the device. In some embodiments, the breakable portion may be removed from the device. In other embodiments, a portion of the breakable portion may be severed. In some embodiments, the breakable portion may be separated through use, handling, transport, or the like. The method 600 may then include forming a charm (step 606). In some embodiments, the charm may be formed by injection molding. In other embodiments, the charm may be formed by 3D printing. The method 600 may then include securing the charm to the fixed charm mount (step 608). The charm may be secured to the fixed charm mount by glue, adhesive, cement, or the like.

Figure 7:
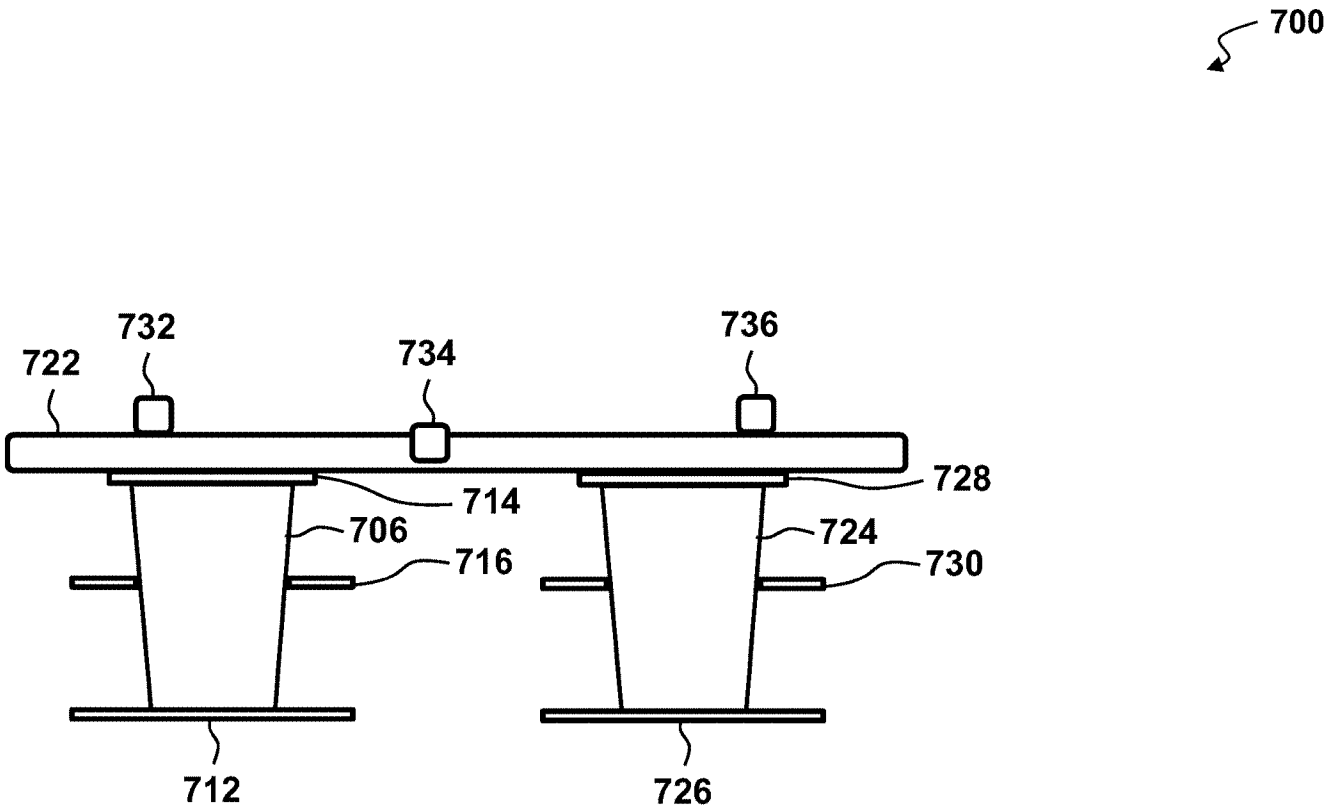
FIG. 7 depicts a side view of an alternate device for displaying a charm with multiple connection points, according to one embodiment.

FIG. 7 depicts a side view of an alternate device 700 for displaying a charm with multiple connection points. The alternate device 700 may function as the device shown in FIGS. 1-4 but with multiple connection points. In some embodiments, the charm 722 may be attached with multiple connection points/devices such as a first tapered shaft 706, a first fixed footwear holder 712, a first fixed charm mount 714, a first floating washer 716, a second tapered shaft 724, a second fixed footwear holder 726, a second fixed charm mount 728, a second floating washer 730. The first tapered shaft 706 and second tapered shaft 724 may be inserted into respective apertures in footwear, such as shown in FIGS. 1 and 3. The charm 722 may be connected to two or more fixed charm mounts 714, 728. In one embodiment, the charm may include a sign that spans a width of the footwear and is connected on either end at two respective apertures in the footwear. In another embodiment, the charm may include a large patch that covers a larger portion of the footwear with two or more connection points, such as 2-3 connection points. The size and dimensions of the tapered shafts 706, 724 may change to accommodate this large patch. The charm 1722 may contain a design, image, word, letter, insignia, or the like. In some embodiments, the charm may contain real gems; fake gems; metal; metallic embellishment details, such as emblems, chains, buckles, etc.; textile elements; and the like. The charm 722 may have a two-dimensional effect in some embodiments where a design on the charm may be flat or substantially flat to a wearer. The charm 722 may have a three-dimensional effect in some embodiments where a design on the charm may have three-dimensional elements. In some embodiments, the charms may include additional elements, e.g., batteries 734, speakers, RFID, GPS locators 732, light up elements 736 such as light-emitting diodes (LEDs), and the like.

It is contemplated that various combinations and/or sub-combinations of the specific features and aspects of the above embodiments may be made and still fall within the scope of the invention. Accordingly, it should be understood that various features and aspects of the disclosed embodiments may be combined with or substituted for one another in order to form varying modes of the disclosed invention. Further, it is intended that the scope of the present invention is herein disclosed by way of examples and should not be limited by the particular disclosed embodiments described above.

What is claimed is:

1. A device comprising:

a tapered shaft having a first end and a second end, wherein the first end is distal from the second end, wherein a diameter of the first end is smaller than a diameter of the second end;

a fixed footwear holder secured to the first end of the tapered shaft;

a fixed charm mount secured to the second end of the tapered shaft;

a floating washer disposed about the tapered shaft, wherein an aperture of the floating washer has an inner diameter that is greater than the diameter of the first end and less than the diameter of the second end; and wherein the fixed charm mount is configured to securely fasten a charm;

wherein a length of the tapered shaft is greater than a maximum distance between the floating washer and the fixed footwear holder; and wherein the floating washer is secured to the tapered shaft by a breakable portion, and wherein breaking the breakable portion allows the floating washer to move along the maximum distance between the floating washer and the fixed footwear holder.

2. The device of claim 1, wherein a portion of the tapered shaft is configured to be inserted into an aperture in a footwear.

3. The device of claim 2, wherein the fixed footwear holder is configured to secure the device against an inner surface of the footwear.

4. The device of claim 3, wherein the floating washer is configured to secure the device against an outer surface of the footwear.

5. The device of claim 4, wherein the charm is configured to be positioned in an elevated position above the outer surface of the footwear.

6. The device of claim 4, wherein the fixed charm mount is configured to be positioned in an elevated position above the outer surface of the footwear.

7. The device of claim 6, wherein a top surface of the fixed footwear holder comprises a texture to allow for greater grip with an inner surface of the footwear.

8. The device of claim 7, wherein a bottom surface of the floating washer comprises a texture to allow for greater grip with an outer surface of the footwear.

9. The device of claim 1, wherein the tapered shaft is a single piece.

10. The device of claim 1, wherein the tapered shaft, the fixed footwear holder, the fixed charm mount, and the floating washer are formed as a single piece.

11. The device of claim 1, wherein the charm is secured to the fixed charm mount by at least one of: a glue, an adhesive, and a cement.

12. The device of claim 1, wherein device further comprises one or more of: a battery, a speaker, an RFID, a GPS locator, and a light up element.

13. The device of claim 1, wherein device further comprises one or more of: a real gem, a fake gem, a metal, a metallic embellishment detail, and a textile element.

* * * * *